United States Patent [19]

Hire et al.

[11] 4,255,630

[45] Mar. 10, 1981

[54] MULTI-CIRCUIT ELECTRICAL SWITCH

[75] Inventors: Charles J. Hire; Gary L. Deppe, both of Mansfield, Ohio

[73] Assignee: Hi-Stat Manufacturing Company, Inc., Lexington, Ohio

[21] Appl. No.: 42,771

[22] Filed: May 29, 1979

[51] Int. Cl.[3] ..... H01H 35/34

[52] U.S. Cl. ..... 200/81.4; 200/83 R; 200/18; 340/626

[58] Field of Search ..... 340/626; 200/83 P, 83 J, 200/83 R, 81.4, 243, 18, 16 A

[56] References Cited

U.S. PATENT DOCUMENTS

| | | | |
|---|---|---|---|
| 2,744,977 | 5/1956 | Lombard | 200/83 J |
| 3,408,464 | 10/1968 | Earleyioine, Jr. | 200/16 A |
| 3,731,295 | 5/1973 | Van Luyn | 200/83 R |
| 3,786,210 | 1/1974 | Byam | 200/81.4 |
| 4,064,381 | 12/1973 | Mullen | 200/16 A |

*Primary Examiner*—Gerald P. Tolin
*Attorney, Agent, or Firm*—Lon H. Romanski

[57] ABSTRACT

An electrical switch assembly is shown as having a housing carrying three electrical terminals with first and second of such terminals respectively terminating in first and second fixed electrical contacts and the third of such terminals being electrically connected to a conductive spring; a further third fixed electrical contact, spaced from the first and second fixed contacts of the first and second terminals, has an aperture formed therein permitting the extension therethrough of an actuator which in turn carries a movable contact which is situated generally between the third fixed contact and the first and second fixed contacts with the spring engaging and urging the movable contact and actuator in a direction whereby the movable contact is moved toward the third fixed contact; a pressure responsive diaphragm situated generally at a side of the third fixed contact operatively engages the actuator and upon sensing sufficient pressure is effective to move the actuator and movable contact against the spring and towards the first and second fixed contacts of the first and second terminals.

33 Claims, 13 Drawing Figures

MULTI-CIRCUIT ELECTRICAL SWITCH

FIELD OF INVENTION

This invention relates generally to electrical switches and, in particular, to electrical switches responsive to fluid pressure.

BACKGROUND OF THE INVENTION

Heretofore the prior art has proposed various embodiments of fluid pressure responsive electrical switches. However, such prior art switches have usually required the use of pressure responsive diaphragms, or the like, which carried a movable contact or contacts where such contact or contacts were secured to the diaphragm as by rivet means, or the like, extending through the diaphragm. Such rivet means, in turn, created leakage paths by which the pressurized fluid being monitored often passed eventually causing a failure of the switch assembly.

Accordingly, the invention as herein disclosed and claimed is primarily intended for the solution of the problems of the prior art as well as other related and attendant problems.

SUMMARY OF THE INVENTION

According to the invention, an electrical switch assembly comprises housing means carrying pressure responsive diaphragm means having one side thereof exposed to a monitored fluid pressure and the other side thereof juxtaposed to a movable electrically insulating plunger-like member guidingly received through a surrounding electrically conductive member, a fixed electrical contact is carried by the housing means as to be spaced from the electrically conductive member, and a movable electrical contact is carried by the plunger-like member and is situated as to be generally between said electrically conductive member and said fixed electrical contacts said diaphragm when experiencing a sufficient pressure thereagainst from said monitored fluid pressure being effective to move said plunger-like member and said movable contact toward said fixed contact as to thereby have said movable contact and said fixed contact in inoperative engagement with each other, said diaphgram when not experiencing said sufficient pressure permitting said plunger-like member to move in a direction generally away from said fixed contact as to thereby enable said movable contact to operatively engage said electrically conductive member.

Various general and specific objects, advantages and aspects of the invention will become apparent when reference is made to the following detailed description considered in conjunction with the accompanying drawings.

BRIEF DESCRIPTION OF THE DRAWINGS

In the drawings, wherein for purposes of clarity certain details and/or elements may be omitted from one or more views.

DETAILED DESCRIPTION OF THE PREFERRED EMBODIMENT

Figure 1:
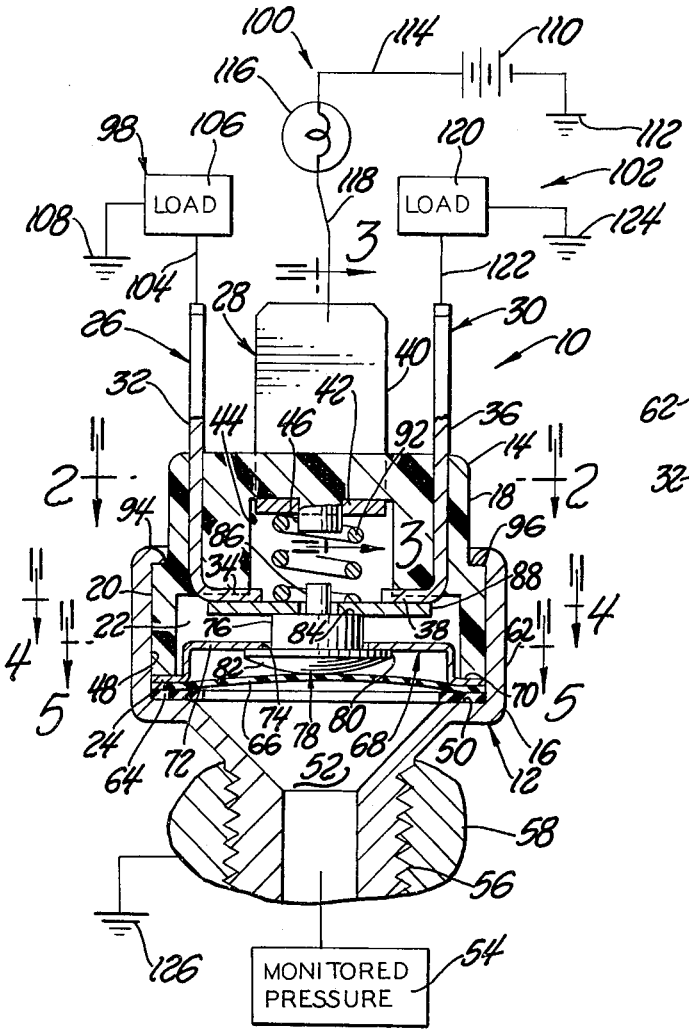
FIG. 1 is an axial cross-sectional view of an electrical switch assembly embodying teachings of the invention.

Referring now in greater detail to the drawings, FIG. 1 illustrates a switch assembly 10 as comprising housing means 12, in turn, comprising an upper housing or body section 14 and a lower housing or body section 16. In the preferred embodiment upper body section 14 is comprised of suitable dielectric material and formed as to have generally cylindrical portions 18 and 20 with portion 20 being generally tubular or defining, in effect, an inverted cup-like configuration, having a chamber-like space 22, and terminating as in an annular end surface 24. In the embodiment illustrated a plurality of lead or terminal means 26, 28 and 30 are operatively fixedly secured to and carried by upper housing section 14. Terminal means 26 comprises a shank-like portion 32 which, preferably, continues in its extension beyond housing section 14 and is operatively connected to or integrally formed with a contact portion 34. As generally depicted, in the preferred embodiment, contact portion abuts against a portion of housing section 14. Similarly, terminal means 30 comprises a shank-like portion 36 which, preferably, continues in its extension beyond housing section 14 and is operatively connected to or integrally formed with a contact portion 38 which, in turn, preferably also abuts against a juxtaposed portion of housing section 14. Lead or terminal means 28 comprises a shank-like portion 40 which, preferably, continues in its extension beyond housing section 14 and is operatively connected to or integrally formed with a leg-like contact portion 42 which is received as within a generally transverse slot or recess 44 formed in housing section 14. Preferably, contact portion 42 is provided with an aperture 45 through which extends a post-like pilot portion 46 which may be formed integrally with body section 14. Although not illustrated, it is contemplated that the post portion 46 may be of an inverted truncated conical configuration (as would be viewed in FIG. 1) with contact portion 42 being formed to provide a complementary conical-like cap which would fit over such contemplated post.

Figure 2:
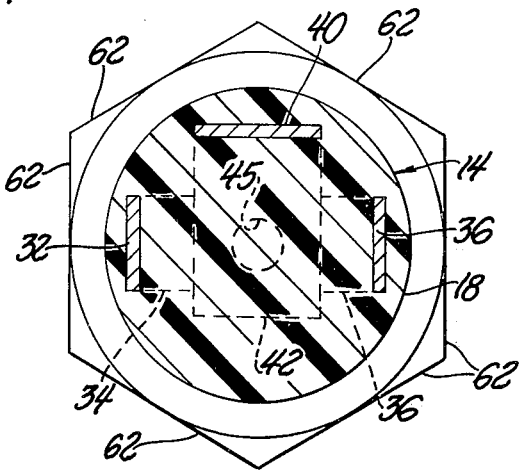
FIG. 2 is a transverse cross-sectional view taken generally on the plane of line 2—2 of FIG. 1 looking in the direction of the arrows and illustrating, in hidden line, some portions of the elements below the plane of view.

Housing or body section 16, which, in the preferred embodiment, is comprised of electrically conductive material, has an open upper end and a cylindrical inner surface 48 which closely receives the cylindrical portion 20 of upper body section 14. A generally transversely oriented inner annular axial end surface 50 generally meets with passage means 52 which, in turn, is effective for communicating with a related source 54 of fluid pressure being monitored by the switch assembly 10. Preferably, the lower portion of housing section 16 is externally threaded as at 56 so as to enable the switch assembly 10 to be fluid-tight threadably engaged with related structure 58 which, in fact, may contain the monitored fluid pressure, and, for example, comprise a portion of an internal combustion engine or the like. To assist in affecting such threadable engagement, the housing section 16 is preferably provided with appropriate tool-engaging surface means such as that depicted, for example, at 62 of FIG. 2.

Referring still to FIG. 1, an annular gasket member 64, comprised of rubber or other suitable material, is situated against the inner annular end surface 50 and serves, in effect, as a seating or sealing surface for a pressure responsive diaphragm member 66 placed thereacross in a manner so that a generally peripheral annular portion thereof is in annular juxtaposition with gasket member 64. In the preferred embodiment, diaphragm member 66 is formed of "Kapton". "Kapton" is a trademark of the E. I. duPont de Nemours & Company for a polyimide film (usually 1 to 5 mils thick). Polyimide is a polymer derived from pyromellitic dianhydride and an aromatic diamine. Generally, the properties of polyimide have been reported as: (a) specific gravity 1.42; (b) tensile strength 13,500 psi; (c) water absorption (24 hrs. at 77° K.) 0.3%; (d) heat distortion point above 500° F.; (e) dielectric constant at 2000 m.c. 3.2; and (f) coefficient of linear expansion $28.4\times10^{-6}$in./in./° F.; with excellent frictional characteristics, good wear resistance at high temperatures, resistant to organic materials at high temperatures and resists combustion.

Figure 5:
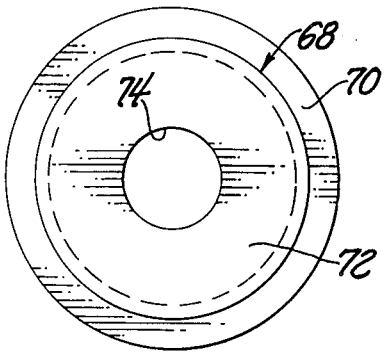
FIG. 5 is a top plan view of another of the elements of the structure of FIG. 1 taken as on the plane of line 5—5 of FIG. 1 and looking in the direction of the arrows.

A generally inverted cup-like electrically conductive member 68, having a laterally extending annular flange portion 70, is situated generally on the other side of diaphragm member 66 in a manner as to peripherally contain and retain the diaphragm between the flange portion 70 and gasket 64 as to effectively seal conduit means 52 from communication with chamber 22. As also shown in FIG. 5, electrically conductive member or contact 68 has an upper-most wall portion 72 through which is formed an aperture 74 for slidably receiving a generally cylindrical body portion 76 of a plunger-like or actuator member 78 which has a lower disposed head-like portion 80 of an effective diameter or width sufficiently large to prevent its passage through aperture or passage means 74. The lower disposed surface 82 of head 80 is preferably curvilinear or spherically or generally of rounded contour. Actuator or motion transmitting member 78 has its body 76 terminate as at an upper planar surface 84 from which, centrally thereof, an extension portion 86 (which may be integrally formed with body 76) extends upwardly.

Figure 4:
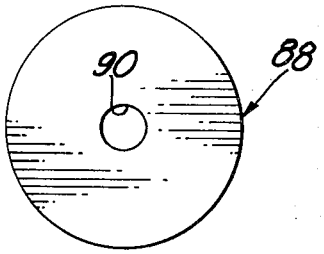
FIG. 4 is a top plan view of one of the elements of the structure of FIG. 1 taken on the plane of line 4—4 of FIG. 1 and looking in the direction of the arrows.
Figure 3:
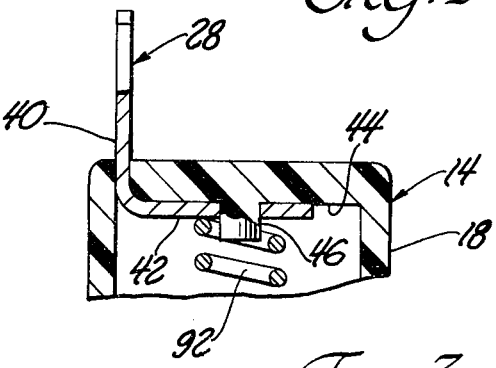
FIG. 3 is a fragmentary cross-sectional view taken generally on the plane of line 3—3 of FIG. 1 and looking in the direction of the arrows.

An annular electrically conductive movable contact member 88 (also shown in FIG. 4) is situated against actuator surface 84 and retained thereon against lateral movement relative thereto by the cooperative action of extension 86 being received through an aperture 90 formed in contact 88. Electrically conductive spring means, such as, for example, a coiled compression spring 92, is situated as to have its opposite ends in respective electrical engagement with contact portion 42 of lead or terminal means 28 and movable contact means 88. Preferably, the spring 92 is positioned as to have its opposite ends respectively situated about posts 46 and 86 thereby preventing undue transverse or lateral movement of such spring ends.

With the various elements described and depicted in FIG. 1, the upper open end 94 of lower housing section 16 may be, for example, rolled-over and against an annular shoulder 96 of upper housing section 14 to thereby retain the elements in assembled relationship.

OPERATION

The switch assembly of the invention may, of course, be employed in any electrical environment; for purposes of illustration the switch assembly 10 is shown operatively connected to circuit means 98, 100 and 102. Circuit means 98 comprises conductor means 104 electrically connected to lead or terminal means 26 and electrical load means 106 which, in turn, is electrically grounded as at 108. Circuit means 100 is illustrated as comprising a source of electrical potential 100, grounded as at 112, and electrically connected via conductor means 114 to electrical load means, such as an indicator bulb 116, and through conductor means 118 to lead or terminal means 28. Circuit means 102 is illustrated as comprising load means 120 electrically connected as via conductor means 122 to lead or terminal means 30 and grounded as at 124. Another electrical path is illustrated as being established by lower housing section 16, and associated structure 58 leading to ground as at 126.

During conditions wherein the magnitude of the pressure of the monitored fluid pressure is less than a preselected or predetermined magnitude, spring means 92 is effective to hold movable contact 88 against the bridging fixed contact 68. In so doing the motion transmitting means or plunger-like member 78 is also held in its down-most position wherein, for example, end surface 84 thereof may be effectively coplanar with the top surface of wall portion 72 of fixed contact 68. During such an assumed condition of operation, with assumed circuit means as illustrated, a circuit is completed as described by ground 112, source of electrical potential 110, conductor 114, load 116, conductor 118, lead or terminal means 28, spring 92, movable contact 88, fixed contact 68, lower housing section 16, structure 58 and back to ground as at 126. Of course, any load in such described circuit would become energized.

When the magnitude of the pressure of the monitored fluid pressure becomes sufficiently great, the resulting force created against diaphragm 66 becomes sufficient to overcome the preload force of spring 92; that is, at that time, diaphragm 66 moves against and causes actuator 78 to move upwardly thereby first lifting movable contact 88 off of fixed contact 68 (thereby opening the circuit previously described) and eventually moving such contact 88 up and into operative engagement with fixed contact portions 34 and 36, as illustrated in FIG. 1. When that happens second and third circuits are closed. That is, such second circuit would be comprised of ground 112, source of electrical potential 110, conductor 114, load 116, conductor 118, lead or terminal means 28, spring 92, movable contact 88, contact portion 34, shank portion 32, conductor 104, load 106 and back to ground as at 108. Similarly, such third circuit would be comprised of ground 112, source of electrical potential 110, conductor 114, load 116, conductor 118, lead or terminal means 28, spring 92, movable contact 88, contact portion 38, shank portion 36, conductor 122, load 120 and back to ground as at 124. As should be obvious, when in the condition depicted in FIG. 1, two parallel branch circuits are supplied by the source 110.

SECOND EMBODIMENT

Figure 6:
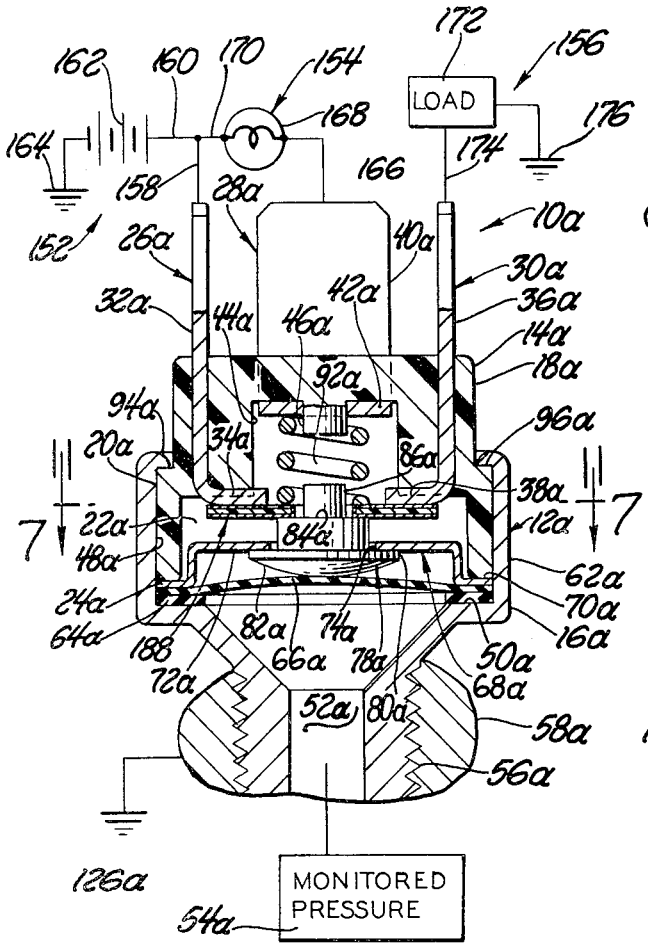
FIG. 6 is a view similar to that of FIG. 1 but illustrating a second embodiment of structure employing teachings of the invention.

Another embodiment of the invention is illustrated in FIG. 6. All elements therein which are like or similar to those of FIG. 1 are identified with like reference numerals provided with a suffix "a".

In comparing the structures of FIGS. 1 and 6, it will be seen that the two are illustrated as being identical with the exception that movable contact means 188 of FIG. 6 differs from movable contact means 88 of FIG. 1. The movable contact means 188 is better illustrated, in relatively enlarged scale, in FIGS. 7 and 8.

Figure 7:
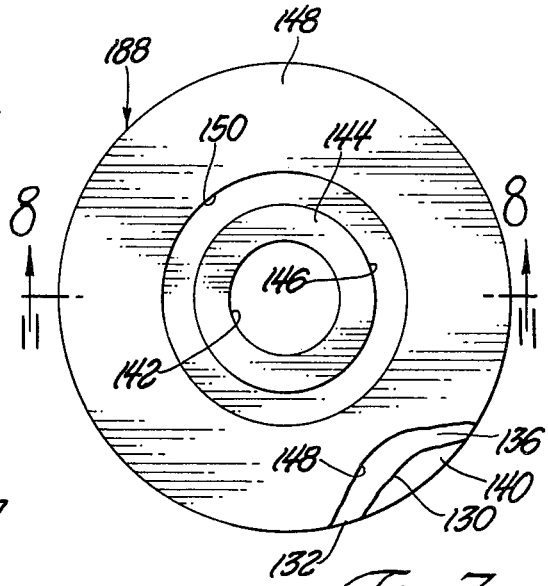
FIG. 7 is an enlarged top plan view of one of the elements of the structure of FIG. 6 taken as on the plane of line 7—7 of FIG. 6 and looking in the direction of the arrows.
Figure 8:
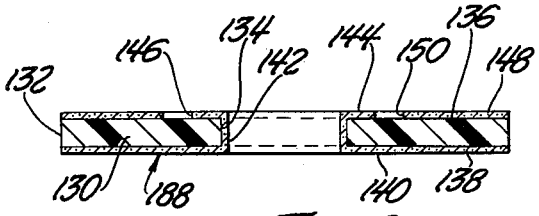
FIG. 8 is a cross-sectional view taken generally on the plane of line 8—8 of FIG. 7 and looking in the direction of the arrows.

Referring in greater detail to FIGS. 7 and 8, the movable contact means 188 is illustrated as comprising a disc-like annular body 130 of electrically non-conductive material preferably having a circular outer periphery 132 and a centrally located aperture or passage 134. The upper 136 and lower 138 surfaces of body 130 carry electrically conductive portions or paths thereon. For ease and clarity of illustration such conductive paths or portions, hereinafter described, are illustrated, in cross-section, in heavy black lines. A layer of electricaly conductive material 140, carried at and by the lower surface 138, is, preferably, of annular configuration as to, effectively, be coextensive with surface 138. A generally cylindrical or tubular layer or portion 142 of electrically conductive material is carried against and by the surface of aperture or passage 134. The portions or layers 140 and 142 are effectively joined to each other as to, in effect, form a single electrical path. A first annular or ring-like electrically conductive portion 144 is carried at and by the upper surface 136 of body 130 as to form, when viewed for example in FIG. 8, an annular flange-like portion having an effective outer periphery 146. As should be apparent, portions 144, 142 and 140 cooperate to define one electrically conductive path. A second annular or ring-like electrically conductive portion 148 is carried at and by the upper surface 136. As illustrated, the inner periphery 150 is spaced from the outer periphery 146 of portion 144 while the outer periphery of portion 148 may be coextensive with the outer periphery of body 130. As also should be apparent, electrically conductive portion 148 is electrically isolated or insulated from conductive portions 144, 142 and 140.

In the preferred embodiment of movable contact means 188, the various electrically conductive portions and paths, already described, are formed on body 130 by a process or processes commonly employed in making printed circuit boards or the like. However as should be obvious, such electrically conductive paths and/or portions may be formed as by electrically conductive material suitably affixed to a related electrically insulating body 130 with such being done, for example, by mechanical fastening means or suitable cementing means.

OPERATION OF SECOND EMBODIMENT

As with regard to switch assembly 10, switch assembly **10*a* may, of course, be employed in any electrical environment; for purposes of illustration the switch assembly 10*a* is shown operatively connected to circuit means 152, 154 and 156. Circuit means 152 comprises conductor means 158 electrically connected to lead or terminal means 26*a* and through conductor means 160 to a source of electrical potential 162 which, in turn, is electrically grounded as at 167. Circuit means 154 is illustrated as comprising conductor means 166 electrically connected to lead or terminal means 28*a* and to an electrical load, such as bulb means 168, and through conductor means 170 to conductor 160, source 162 and ground 164. Circuit 156 is illustrated as comprising load means 172 electrically connected via conductor means 174 to lead or terminal means 30*a* and grounded as at 176. A further electrical path is illustrated as being established by lower housing section 16*a* and associated structure 58*a* leading to ground as at 126*a***.

During conditions wherein the magnitude of the pressure of the monitored fluid pressure is less than a preselected or predetermined magnitude, spring means **92*a* is effective to hold movable contact means 188 against bridging fixed contact 68*a*. In so doing, the motion transmitting means or plunger-like member 78*a* is also held in its effectively down-most position wherein, for example, end surface 84*a* thereof may be effectively coplanar with the top surface of wall portion 72*a* of fixed contact 68*a*. During such an assumed condition of operation, with assumed circuit means as illustrated, a circuit is completed as described by ground 164 source of electrical potential 162, conductors 160, 170, load or lamp 168, conductor 166, shank portion 40*a* and contact portion 42*a* of lead or terminal means 28*a*, spring 92*a*, annular conductive portion 144 against which the lower end of spring 92*a* engages (of movable contact means 188), tubular conductive portion 142 (of contact means 188), annular conductive portion 140 (of contact means 188), fixed contact 68*a* (which is at such time in electrical engagement with conductive portion 140), housing section 16*a*, structure 58*a* and back to ground as at 126*a*. At this time the assumed load 168** is energized.

When the magnitude of the pressure of the monitored fluid pressure becomes sufficiently great, the resulting force created against diaphragm **66*a* becomes sufficient to overcome the preload force of spring 92*a*; that is, at that time, diaphragm 66*a* moves against and causes actuator 78*a* to move upwardly thereby first lifting movable contact means 188 off of fixed contact 68*a* (thereby opening the immediately previously described closed circuit) and eventually moving such contact means 188 up and into operative engagement with fixed contact portions 34*a* and 36*a*, as depicted in FIG. 6. When that happens a different circuit is closed and such is comprised of circuit means 152 and 156. More specifically, with contact means 188 in its FIG. 6 position, a circuit is completed and described by ground 164, source of electrical potential 162, conductors 160, 158, shank portion 32*a* and contact portion 34*a* of lead or terminal means 26*a*, annular conductive portion 148 of movable contact means 188, fixed contact portion 38*a* and shank portion 36*a* of lead or terminal means 30*a*, conductor means 174, electrical load means 172 and back to ground as at 176. As should be apparent, in the FIG. 6 depicted condition, the circuit as between spring 92***a* and fixed contact 68*a* is open and the space between inner periphery 150 of annular contact portion 148 and the outer periphery 146 of annular contact portion 144 precludes energization of load 168

Figure 9:
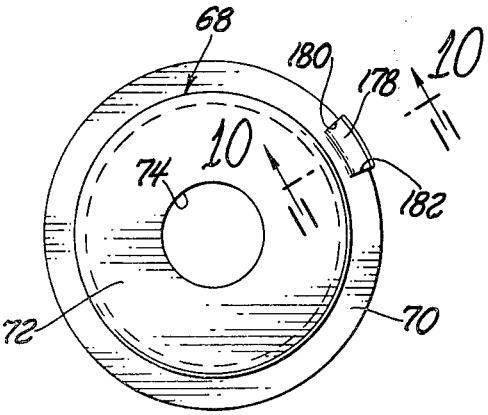
FIG. 9 is a view similar to that of FIG. 5 illustrating a modification thereof.
Figure 10:
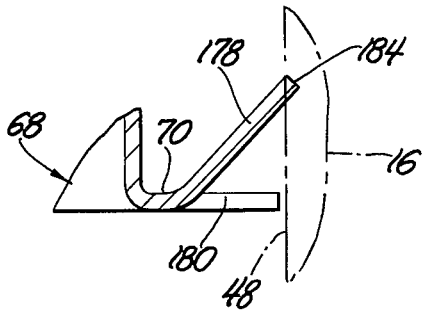
FIG. 10 is an enlarged cross-sectional view of a fragmentary portion of the element shown in FIG. 9 taken generally on the plane of line 10—10 of FIG. 9 and looking in the direction of the arrows.

FIGS. 9 and 10 illustrate a contemplated further embodiment of the fixed contact member 68 and/or 68*a*. All elements in FIGS. 9 and 10 which are like or similar to those of FIGS. 1, 5 and/or FIG. 6 are identified with reference numbers corresponding to those of FIGS. 1 and/or 5.

Referring in greater detail to FIGS. 9 and 10, the fixed contact 68 is illustrated as comprising a portion 178 struck or cut out of the flange portion 70 (as to leave sides 180 and 182 in flange 70) and formed as to have a relatively upwardly inclined configuration as depicted, for example, in FIG. 10. In the forming of fixed contact 68 and tang-like portion 178, such portion 178 is preferably formed somewhat effectively longer as to thereby have its free end 184 extending beyond the circumferential limit of flange 70. Accordingly, when assembling the fixed contact 68 to housing section 16, it is pressed into the interior of housing section 16 and in so doing the tang or tab 184 is somewhat resiliently deflected. However, upon the fixed contact 68 being seated against diaphragm 66 or 66*a*, such tab or tang continues to inherently urge itself into electrical contact with surface 48 (or 48*a*) of the lower housing section 16 (or 16*a*) thereby assuring a continued electrical connection therebetween.

Figure 11:
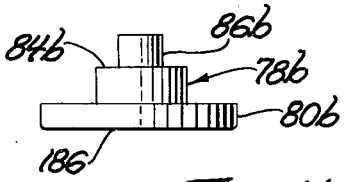
FIG. 11 is a side elevational view of another embodiment of one of the elements shown in FIGS. 1 and 6.

Also, it is contemplated that the motion transmitting means 78 or 78*a* (as shown at FIGS. 1 or 6) may take different forms. For example, FIG. 11 illustrates a modified embodiment of such motion transmitting or actuator means; in FIG. 11, elements which are like or similar to those of the embodiments 78 or 78*a* are identified with like reference numerals provided with a suffix "b". An inspection of the structure of FIG. 11 will disclose that, in the main, actuator means 78*b* is much like actuator means 78 and/or 78*a* with the exception that, preferably, the effective width or diameter of head portion 80*b* is substantially greater than that of either 80 or 80*a* and that the lower disposed end surface 186 of actuator means 78*b* is relatively flat over its effective area, instead of rounded as at 82 or 82*a* of FIGS. 1 or 6, thereby enabling greater portion of the cooperating diaphragm 66 or 66*a* to move quickly and effectively engage the total end surface 186 in moving the actuator 78*b* upwardly during conditions as hereinbefore described.

Figure 12:
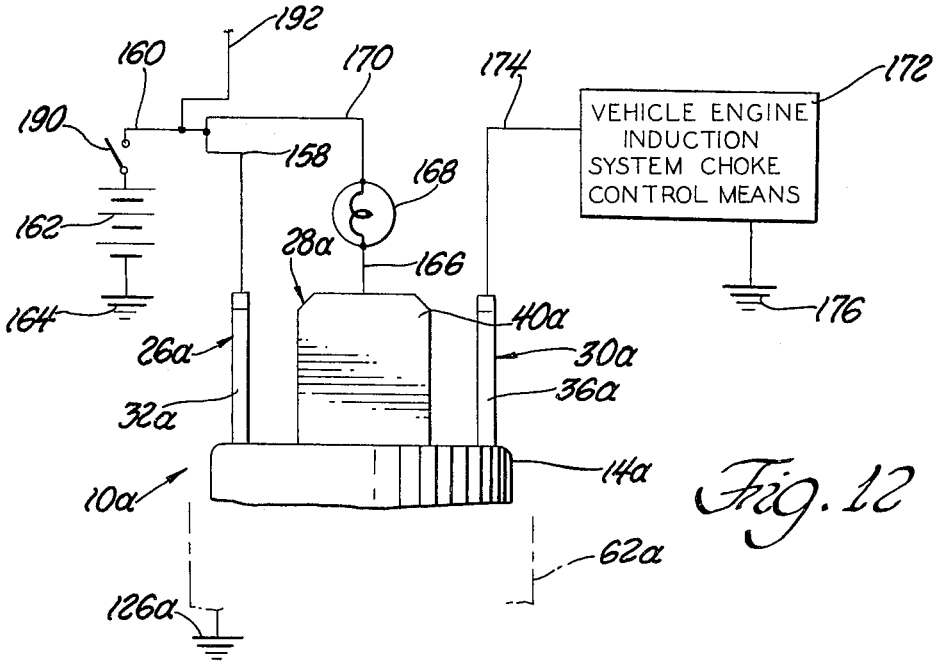
FIG. 12 is a view of a fragmentary portion of the switch means of FIG. 6 employed in combination with an electrical circuit applicable to an engine system.

FIG. 12, in somewhat greater detail illustrates the switch assembly 10*a* within an environment of, for example, an internal combustion engine wherein portion 58*a* (FIG. 6) may form a part of the engine and wherein 54*a* (FIG. 6) may be the engine oil or lubricating system so that the pressure of such oil is continually monitored by and reacted to by the switch assembly 10*a*. In comparing FIGS. 6 and 12, it can be seen that the load 172 of FIG. 6 is identified in FIG. 12 as being the vehicle engine induction system choke control means. For example, some engine induction system choke means operate on the basis of causing the choke means to be opened or actuated to a preselected position immediately upon the engine becoming started. Usually, for all practical purposes, the engine oil pressure can be assumed to reach its normal relatively high operating pressure simultaneously with the engine becoming started.

Accordingly, still referring to both FIGS. 6 and 12, it can be seen that, with the related engine being cold and shut-down, upon closing of the ignition switch means 190 (thereby energizing the ignition system 192 and related engine cranking means) the monitored oil pressure will be relatively low thereby having switch contact means 188 in its lower-most position and completing the electrical circuit from terminal means 28*a* through ground 126*a* resulting in oil pressure indicator lamp 168 being energized signaling a low oil pressure. At this time the circuit between terminal contacts 34*a* and 38*a* is opened. When the engine is started, the monitored oil pressure increases to a sufficiently high magnitude resulting in diaphragm 66*a* moving contact means 188 to the position depicted in FIG. 6 thereby opening the previously established electrical circuit between terminal means 28*a* and ground 126*a*, and, instead, closing the electrical circuit between contact portions 34*a* and 38*a* of terminal means 26*a* and 30*a* as to cause deenergization of the low-pressure indicator lamp 168 and the energization of the vehicle engine induction system choke control means 172.

THIRD EMBODIMENT

Figure 13:
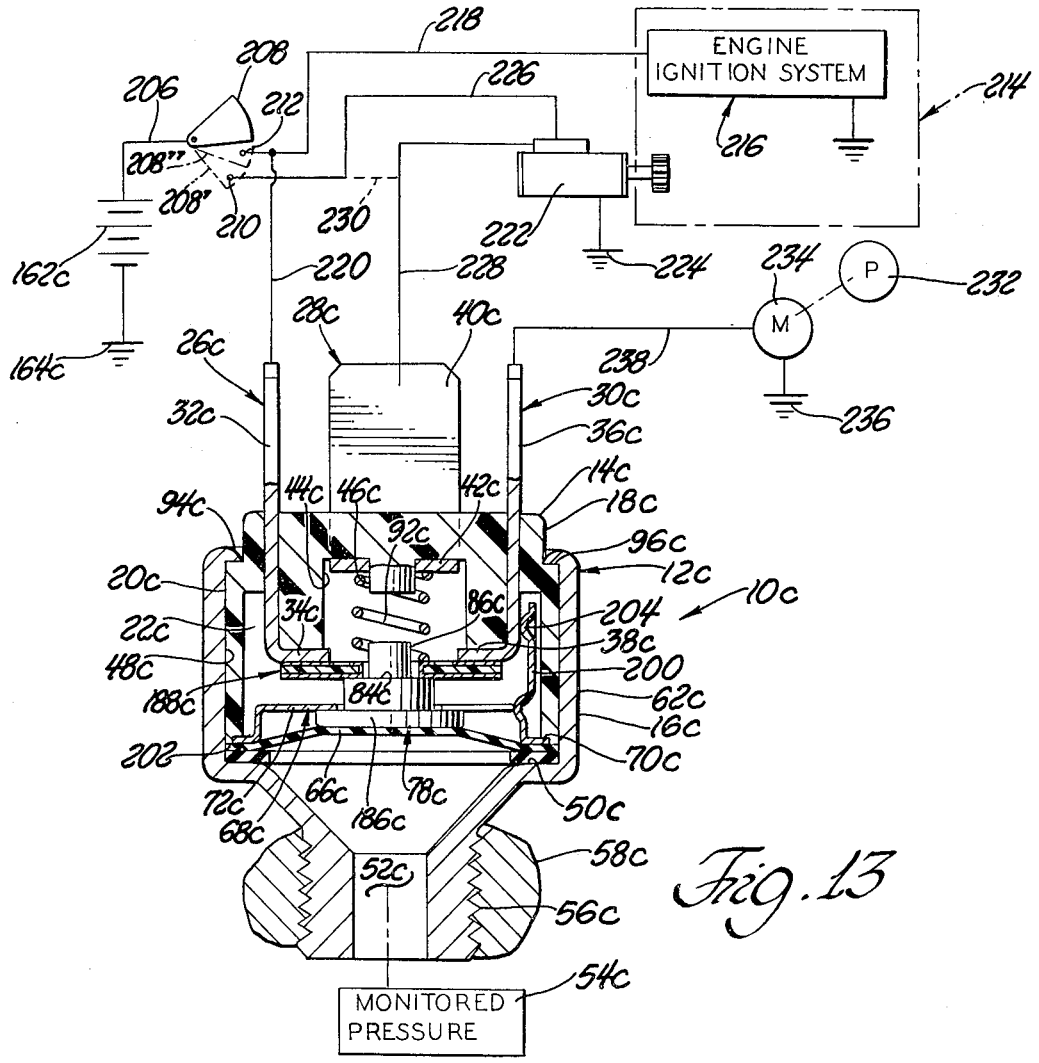
FIG. 13 is a view similar to that of FIG. 6 but illustrating a further embodiment of structure employing teachings of the invention.

Another embodiment of the invention is illustrated in FIG. 13. All elements therein as are like or similar to those of FIG. 6 or FIG. 11 are identified with like reference numerals provided with a suffix "c", with modifications and/or changes being designated by succeeding next higher reference numbers.

In comparing the structures of FIGS. 6 (modified as in view of FIG. 11) and 13, it will be seen that the two are illustrated as being generally identical with the exceptions that contact 68*c* is provided with an arm-like portion or extension 200 and the axial end 202 of upper body or housing portion 14*c* may be stepped as to generally confine, within such annular step, the flange 70*c* of contact 68*c* thereby preventing the completion of an electrical circuit as between contact 68*c* and lower housing or body section 16*c*. That is, the embodiment depicted in FIG. 13 may be considered as a non-grounding type whereby no electrical ground circuit is completed through the housing section 16*c*. Obviously, other means may be employed for so preventing the completion of such a ground circuit. For example, the housing section 16*c* could be made of dielectric material; or if housing section 16*c* were to be of electrically conductive material, then, of course, contact means 68*c* could be suitably peripherally insulated therefrom or the housing section 16*c* could be electrically insulated as from the grounded or ground structure 58*c* as by, for example, an electrically insulating material intermediate the housing section 16*c* and structure 58*c*.

As depicted in FIG. 13, the conductive arm means 200 may be struck and formed from the transverse wall portion 72*c* and, preferably, provided with a projecting-like contacting portion 204 which electrically contacts terminal means 30*c* as by electrical engagement with shank portion 36*c* thereof.

The switch assembly 10*c* is illustrated as in an overall electrical system which comprises a source of electrical potential 162 electrically connected as by conductor means 206 to switch contact means 208 which may comprise the usual vehicular engine ignition and engine starter key operated switch. As generally depicted, the switch 208, when in an "off" position is as shown in solid line while when moved to an engine cranking condition it assumes a position as partially indicated in phantom line at 208'. Upon the engine being started, the switch member 208 is permitted to be moved from the phantom line position of 208' to the phantom line position of 208''. Obviously, as schematically depicted, when in the 208' position both fixed contacts 210 and 212 are in electrical engagement therewith and when in the 208'' position only fixed contact 212 is electrically connected thereto.

The associated combustion engine, depicted at 214, has a related ignition system 216 which is electrically connected to contact 212 as by conductor means 218. Terminal means 26c is also electrically connected to contact 212 as through conductor means 220 and a portion of conductor means 218. An engine cranking or starter motor 222, connected to ground as at 224, is electrically connected to contact 210 as via conductor means 226 and terminal means 28c may be electrically connected to contact 210 by conductor means 228 generally through the starter motor 222 or, as depicted in dash line at 230, directly to contact 210 as through, for example, a portion of conductor means 226. An engine fuel pump 232 is operatively connected to and driven by an electric motor 234 which is grounded as at 236 and electrically connected to terminal means 30c as by conductor means 238.

OPERATION OF FIG. 13 EMBODIMENT

For purposes of discussion, let it be assumed that the engine 214 is shut down and switch 208 is in its illustrated "off" position. At this time the magnitude of the monitored engine oil pressure at 54c will be zero (or relatively low) thereby having contact means 188c held against lower fixed contact 68c by the action of spring 92c. Consequently, as through switch 10c at such time, an electrical circuit is established and completed from terminal means 28c, through spring 92c, conductive portions 144, 142 and 140 (FIG. 8) of contact means 188c, lower fixed contact 68c, arm or extension 200 and contact portion 204 thereof, and, to shank portion 36c of terminal means 30c. Accordingly, it can be seen that at such an engine shut-down condition, when switch contact 208 is moved to its position at 208' the starter or engine cranking motor 222 is energized, via conductor means 226, and the fuel pump motor 234 is also energized (through the described closed circuit of switch means 10c) as by conductor means 228 and conductor means 238. Also, of course, during such engine cranking the ignition system 216 is energized as through conductor means 218 and contact 212.

When the engine 214 is started and becomes self-sustaining, the engine oil monitored pressure almost immediately becomes of a sufficiently high magnitude causing diaphragm 66c to move actuator 78c and contact means 188c upwardly to the respective positions depicted in FIG. 13. Also, as the engine 214 is thusly started, the operator positionable switch 208 is moved from its position at 208' to its position at 208''. As a consequence thereof the electrical circuit between conductive portion 140 (FIG. 8) of contact means 188c and lower fixed contact 68c is opened. However, upon contact means 188c being moved to the position shown in FIG. 13, the generally annular conductive portion 148 (FIG. 8) of contact means 188c serves as an electrical bridging contact completing a circuit as between contact portions 34c and 38c of terminal means 26c and 36c, respectively. Therefore, the switch means 10c continues to provide energization to fuel pump motor 234 (as by the circuit comprised of contact 212, a portion of conductor 218, conductor means 220, terminal shank 32c, terminal contact 34c, conductive portion 148 (FIG. 8), terminal contact 38c, terminal shank 36c, and conductor means 238) while the engine ignition system 216 continues to be energized through conductor means 218.

Although only a preferred embodiment and select number of modifications of the invention have been disclosed and described, it is apparent that other embodiments and modifications of the invention are possible within the scope of the appended claims.

What is claimed is:

1. An electrical switch assembly, comprising housing means, pressure responsive diaphragm means carried by said housing means, a first electrically conductive fixed member carried by said housing means, passage means formed through said first electrically conductive fixed member, movable actuator means extending through said passage means as to have portions thereof disposed at oppsoite sides of said first electrically conductive fixed member, a second electrically conductive fixed member carried by said housing means and spaced from said first electrically conductive fixed member, movable electrical contact means carried by said actuator means and situated as to be generally between said first electrically conductive fixed member and said second electrically conductive fixed member, said diaphragm means having one side thereof generally juxtaposed to said actuator means and an other side thereof opposite to said one side effective to be exposed to a monitored fluid pressure, said diaphragm means when experiencing a sufficient pressure thereagainst from said monitored fluid pressure being effective to move said actuator means and said movable electrical contact means toward said second electrically conductive fixed member as to thereby have said movable electrical contact means and said second electrically conductive fixed member in operative engagement with each other when said diaphragm means is not experiencing said sufficient pressure said actuator means and said movable electrical contact means move in a direction generally away from said second electrically conductive fixed member and result in said movable electrical contact means engaging said first electrically conductive fixed member, a third electrically conductive fixed member carried by said housing means, said third electrically conductive fixed member being situated as the result in said third electrically conductive fixed member being operatively engaged by said movable electrical contact means whenever said movable electrical contact means operatively engages said second electrically conductive fixed member, a fourth electrically conductive fixed member carried by said housing means, said fourth fixed member being spaced from said movable electrical contact means and located at a side thereof which is opposite to the side of said movable electrical contact means at which said first electrically conductive fixed member is located, and electrically conductive connector means electrically interconnecting said fourth fixed member and said movable electrical contact means, wherein said movable electrical contact means comprises at least first and second separate electrically conductive paths, said electrically conductive connector means being in continuous electrical contact with said first separate electrically conductive path as to thereby complete an electrical circuit from said fourth fixed member through said first fixed member whenever said movable electrical contact means moves into operative engagement with said first fixed member and causes operative electrical engagement as between said first separate electrically conductive path and said first fixed member, said movable electrical contact means being effective when moved into operative engagement with said second and third fixed members to cause said second separate electrically conductive path to operatively electrically engage said second and third fixed members as to close an electrical circuit therebetween which is electrically isolated from said electrically conductive connector means and said fourth fixed member.

2. An electrical switch assembly according to claim 1 wherein said passage means comprises a generally circular aperture.

3. An electrical switch assembly according to claim 1 wherein said electrically conductive connector means comprises spring means.

4. An electrical switch assembly according to claim 1 wherein said first electrically conductive fixed member is of a generally cup-shaped configuration.

5. An electrical switch assembly according to claim 1 wherein said electrically conductive connector means comprises a coiled compression sping.

6. An electrical switch assembly according to claim 1 wherein said movable electrical contact means comprises a contact body portion having first and second oppositely disposed faces, wherein said first face carries said second separate electrically conductive path and a portion of said first separate electrically conductive path spaced from said second separate electrically conductive path, and wherein said second face carries the remainder of said first separate electrically conductive path.

7. An electrical switch assembly according to claim 6 wherein said first and second separate electrically conductive paths are formed on said contact body portion as printed circuit portions.

8. An electrical switch assembly according to claim 1 wherein said actuator means comprises a plunger-like member, wherein said movable electrical contact means comprises a movable contact member carried by said plunger-like member as to be extending generally laterally thereof, an aperture formed through said movable contact member, and a locating extension carried by said plunger-like member, and wherein said aperture receives said locating extension as to thereby position said movable contact member with respect to said plunger-like member.

9. An electrical switch assembly according to claim 1 and further comprising conductor means continually electrically interconnecting said first electrically conductive fixed member and said third electrically conductive fixed member.

10. An electrical switch assembly according to claim 9 wherein said first electrically conductive fixed member comprises an extending electrically conductive arm portion having a free end, wherein said conductive arm portion comprises said conductor means, and wherein said free end is electrically operatively engaged with said third electrically conductive fixed member.

11. An electrical switch assembly, comprising housing means, pressure responsive diaphragm means carried by said housing means, a first electrically conductive fixed member carried by said housing means, passage means formed through said first electrically conductive fixed member, movable actuator means extending through said passage means as to have portions thereof disposed at opposite sides of said first electrically conductive fixed member, a second electrically conductive fixed member carried by said housing means and spaced from said first electrically conductive fixed member, movable electrical contact means carried by said actuator means and situated as to be generally between said first electrically conductive fixed member and said second electrically conductive fixed member, said diaphragm means having one side thereof generally juxtaposed to said actuator means and an other side thereof opposite to said one side effective to be exposed to a monitored fluid pressure, said diaphragm means when experiencing a sufficient pressure thereagainst from said monitored fluid pressure being effective to move said actuator means and said movable electrical contact means toward said secnd electrically conductive fixed member as to thereby have said movable electrical contact means and said second electrically conductive fixed member in operative engagement with each other, when said diaphragm means is not experiencing said sufficient pressure said actuator means and said movable electrical contact means move in a direction generally away from said second electrically conductive fixed member and result in said movable electrical contact means engaging said first electrically conductive fixed member, a third electrically conductive fixed member carried by said housing means, said third electrically conductive fixed member being situated as to result in said third electrically conductive fixed member being operatively engaged by said movable electrical contact means whenever said movable electrical contact means operatively engages said second electrically conductive fixed member, and donductor means continually electrically interconnecting said first electrically conductive fixed member and said third electrically conductive fixed member.

12. An electrical switch assembly according to claim 11 wherein said first electrically conductive fixed member comprises an extending electrically conductive arm portion having a free end, wherein said conductor means comprises said conductive arm portion, and wherein said free end is electrically operatively engaged with said third electrically conductive fixed member.

13. An electrical switch assembly according to claim 11 wherein said passage means comprises a generally circular aperture.

14. An electrical switch assembly according to claim 11 wherein said first electrically conductive fixed member is of a generally cup-shaped configuration.

15. An electrical switch assembly according to claim 11 wherein said actuator means comprises a plunger-like member, wherein said movable electrical contact means comprises a movable contact member carried by said plunger-like member as to be extending generally laterally thereof, an aperture formed through said movable contact member, and a locating extension carried by said plunger-like member, and wherein said aperture receives said locating extension as to thereby position said movable contact member with respect to said plunger-like member.

16. An electrical switch assembly according to claim 11 and further comprising a fourth electrically conductive fixed member, and electrically conductive connector means electrically interconnecting said fourth fixed member and said movable electrical contact means.

17. An electrical switch assembly according to claim 16 wherein said electrically conductive connector means comprises spring means.

18. An electrical switch assembly according to claim 17 wherein said spring means comprises coiled compression spring means.

19. An electrical switch assembly according to claim 11 wherein said movable electrical contact means comprises a contact body portion having first and second generally oppositely disposed faces, wherein said first face carries a first electrically conductive path and a portion of a second electrically conductive path, wherein said second face carries a continuance of said second electrically conductive path, wherein said first conductive path is in electrical contact with said second and third electrically conductive fixed members when said movable contact means is in engagement therewith, wherein said portion of said second electrically conductive path is in continuous closed electrical circuit with said electrically conductive connector means, and wherein said continuance of said second electrically conductive path is in electrical contact with said first electrically conductive fixed member when said movable contact means is in engagement therewith.

20. An electrical switch assembly, comprising housing means, pressure responsive diaphragm means carried by said housing means, a first electrically conductive fixed member carried by said housing means, passage means formed through said first electrically conductive fixed member, movable actuator means extending through said passage means as to have portions thereof disposed at opposite sides of said first electrically conductive fixed member, a second electrically conductive fixed member carried by said housing means and spaced from said first electrically conductive fixed member, movable electrical contact means carried by said actuator means and situated as to be generally between said first electrically conductive fixed member and said second electrically conductive fixed member, said diaphragm means having one side thereof generally juxtaposed to said actuator means and an other side thereof opposite to said one side effective to be exposed to a monitored fluid pressure, said diaphragm means when experiencing a sufficient pressure thereagainst from said monitored fluid pressure being effective to move said actuator means and said movable electrical contact means toward said second electrically conductive fixed member as to thereby have said movable electrical contact means and said second electrically conductive fixed member in operative engagement with each other, when said diaphragm means is not experiencing said sufficient pressure said actuator means and said movable electrical contact means move in a direction generally away from said second electrically conductive fixed member and result in said movable electrical contact means engaging said first electrically conductive fixed member, a third electrically conductive fixed member carried by said housing means, said third electrically conductive fixed member being situated as to result in said third electrically conductive fixed member being operatively engaged by said movable electrical contact means whenever said movable electrical contact means operatively engages said second electrically conductive fixed member, said second electrically conductive fixed member comprising first electrical terminal means, said third electrically conductive fixed member comprising second electrical terminal means, third electrical terminal means, electrically conductive connector means continuously electrically interconnecting said third terminal means with said movable electrical contact means, and conductor means continually electrically interconnecting said first electrically conductive fixed member and said third electrically conductive fixed member.

21. An electrical switch assembly according to claim 20 wherein said first electrically conductive fixed member comprises an extending electrically conductive arm portion having a free end, wherein said conductor means comprises said conductive arm portion, and wherein said free end is electrically operatively engaged with said third electrically conductive fixed member.

22. An electrical switch assembly according to claim 21 wherein said first electrically conductive fixed member and said arm portion are comprised of material displaying at least perceptible resilient deflection, and wherein said arm portion through resilient deflection is maintained in operative engagement with said third electrically conductive fixed member.

23. An electrical switch assembly according to claim 20 wherein said movable electrical contact means comprises a contact body portion having first and second generally oppositely disposed faces, wherein said first face carries a first electrically conductive path and a portion of a second electrically conductive path, wherein said second face carries a continuance of said second electrically conductive path, wherein said first conductive path is in electrical contact with said second and third electrically conductive fixed members when said movable contact means is in engagement therewith, wherein said portion of said second electrically conductive path is in continuous closed electrical circuit with said electrically conductive connector means, and wherein said continuance of said second electrically conductive path is in electrical contact with said first electrically conductive fixed member when said movable contact means is in engagement therewith.

24. An electrical switch assembly, comprising housing means, pressure responsive diaphragm means carried by said housing means, first electrically conductive contact means, passage means formed through said first electrically conductive contact means, movable actuator means extending through said passage means as to have portions thereof disposed at opposite sides of said first electrically conductive contact means, second electrically conductive contact means spaced from said first electrically conductive contact means, third electrical contact means carried by said actuator means and situated as to be generally between said first electrically conductive contact means and said second electrically conductive contact means, said diaphragm means having one side thereof generally juxtaposed to said actuator means and an other side thereof opposite to said one side effective to be exposed to a monitored fluid pressure, said diaphragm means when experiencing a first preselected magnitude of pressure thereagainst from said monitored fluid pressure being effective to move said actuator means and said third electrical contact means toward said second electrically conductive contact means as to thereby have said third electrical contact means and said second electrically conductive contact means in operative engagement with each other, when said diaphragm means is experiencing a second preselected magnitude of pressure thereagainst said actuator means and said third electrical contact means move in a direction generally away from said second electrically conductive contact means and result in said third electrical contact means operatively engaging said first electrically conductive contact means, fourth electrically conductive contact means, said fourth electrically conductive contact means being situated as to result in said fourth electrically conductive contact means being operatively engaged by said third electrical contact means whenever said third electrical contact means operatively engages said second electrically conductive contact means, and conductor means continually electrically interconnecting said first electrically conductive contact means and said fourth electrically conductive contact means.

25. An electrical switch assembly according to claim 24 wherein said passage means comprises a generally circular aperture.

26. An electrical switch assembly according to claim 24 wherein said first electrically conductive contact means is of a generally cup-shaped configuration.

27. An electrical switch assembly according to claim 24 wherein said actuator means comprises a plunger-like member, wherein said third electrical contact means comprises a movable contact member carried by said plunger-like member as to be extending generally laterally thereof, an aperture formed through said movable contact member, and a locating extension carried by said plunger-like member, and wherein said aperture receives said locating extension as to thereby position said movable contact member with respect to said plunger-like member.

28. An electrical switch assembly according to claim 24 and further comprising fifth electrically conductive contact means, and electrically conductive connector means electrically interconnecting said fifth contact means and said third electrical contact means.

29. An electrical switch assembly according to claim 28 wherein said electrically conductive connector means comprises spring means.

30. An electrical switch assembly according to claim 29 wherein said spring means comprises coiled compression spring means.

31. An electrical switch assembly according to claim 24 wherein said first electrically conductive contact means comprises an extending electrically conductive arm portion having a free end, wherein said arm portion comprises said conductor means, and wherein said free end is electrically operatively engaged with said fourth electrically conductive contact means.

32. An electrical switch assembly, comprising housing means, pressure responsive diaphragm means carried by said housing means, first electrically conductive contact means, passage means formed through said first electrically conductive contact means, movable actuator means extending through said passage means as to have portions thereof disposed at opposite sides of said first electrically conductive contact means, second electrically conductive contact means spaced from said first electrically conductive contact means, third electrical contact means carried by said actuator means and situated as to be generally between said first electrically conductive contact means and said second electrically conductive contact means, said diaphragm means having one side thereof generally juxtaposed to said actuator means and an other side thereof opposite to said one side effective to be exposed to a monitored fluid pressure, said diaphragm means when experiencing a first preselected magnitude of pressure thereagainst from said monitored fluid pressure being effective to move said actuator means and said third electrical contact means toward said electrically conductive contact means as to thereby have said third electrical contact means and said second electrically conductive means in operative engagement with each other, when said diaphragm means is experiencing a second preselected magnitude of pressure thereagainst said actuator means and said third electrical contact means move in a direction generally away from said second electrically conductive contact means and result in said third electrical contact means operatively engaging said first electrically conductive contact means, fourth electrically conductive contact means, said fourth electrically conductive contact means being situated as to result in said fourth electrically conductive contact means being operatively engaged by said third electrical contact means whenever said third electrical contact means operatively engages said second electrically conductive contact means, said second electrically conductive contact means comprising first electrical terminal means, said fourth electrically conductive contact means comprising second electrical terminal means, third electrical terminal means, electrically conductive connector means continuously electrically interconnecting said third terminal means with said third electrical contact means, and conductor means continually electrically interconnecting said first electrically conductive contact means and said fourth electrically conductive contact means.

33. An electrical switch assembly, comprising housing means, pressure responsive diaphragm means carried by said housing means, first electrically conductive contact means, passage means formed through said first electrically conductive contact means, movable actuator means extending through said passage means as to have portions thereof disposed at opposite sides of said first electrically conductive contact means, second electrically conductive contact means spaced from said first electrically conductive contact means, third electrical contact means carried by said actuator means and situated as to be generally between said first electrically conductive contact means and said second electrically conductive contact means, said diaphragm means having one side thereof generally juxtaposed to said actuator means and an other side thereof opposite to said one side effective to be exposed to a monitored fluid pressure, said diaphragm means when experiencing a first preselected magnitude of pressure thereagainst from said monitored fluid pressure being effective to move said actuator means and said third electrical contact means toward said second electrically conductive contact means as to thereby have said third electrical contact means and said second electrically conductive contact means in operative engagment with each other, when said diaphragm means is experiencing a second preselected magnitude of pressure thereagainst said actuator means and said third electrical contact means move in a direction generally away from said second electrically conductive contact means and result in said third electrical contact means operatively engaging said first electrically conductive contact means, fourth electrically conductive contact means, said fourth electrically conductive contact means being situated as to result in said fourth electrically conductive contact means being operatively engaged by said third electrical contact means whenever said third electrical contact means operatively engages said second electrically conductive contact means, fifth electrically conductive contact means, said fifth contact means being spaced from said third electrical contact means and located at a side thereof which is opposite to the side of said third electrical contact means at which said first electrically conductive contact means is located, and electrically conductive connector means electrically interconnecting said fifth contact means and said third electrical contact means, and wherein said third electrical contact means comprises at least first and second separate electrically conductive paths, said electrically conductive connector means being in continuous electrical contact with said first separate electrically conductive path as to thereby complete an electrical circuit from said fifth contact means through said first contact means whenever said third electrical contact means moves into operative engagement with said first contact means and causes operative electrical engagement as between said first separate electrically conductive path and said first contact means, and said third electrical contact means being effective when moved into operative engagement with said second and third contact means to cause said second separate electrically conductive path to operatively electrically engage said second and third contact means as to close an electrical circuit therebetween which is electrically isolated from said electrically conductive connector means and said fifth contact means.

* * * * *

UNITED STATES PATENT AND TRADEMARK OFFICE

CERTIFICATE OF CORRECTION

PATENT NO. : 4,255,630

DATED : March 10, 1981

INVENTOR(S) : Charles J. Hire and Gary L. Deppe

It is certified that error appears in the above-identified patent and that said Letters Patent are hereby corrected as shown below:

Claim 11, line 23, delete "secnd" and substitute therefor --- second ---.

Claim 11, line 40, change "donductor" to --- conductor ---.

Claim 32, line 22, after "said" insert --- second ---.

Claim 32, line 24, immediately after "conductive" insert --- contact ---.

Signed and Sealed this

*Second* Day of *June 1981*

[SEAL]

*Attest:*

RENE D. TEGTMEYER

*Attesting Officer*

*Acting Commissioner of Patents and Trademarks*